United States Patent [19]

Brock et al.

[11] 4,103,350

[45] Jul. 25, 1978

[54] METHOD OF REDUCING EMISSION OF PARTICULATE MATTER

[75] Inventors: James Donald Brock; Erbie Gail Mize, both of Chattanooga, Tenn.

[73] Assignee: Astec Industries, Inc., Chattanooga, Tenn.

[21] Appl. No.: 780,173

[22] Filed: Mar. 22, 1977

Related U.S. Application Data

[62] Division of Ser. No. 685,087, May 10, 1976.

[51] Int. Cl.[2] ..... B28C 1/22; B28C 5/46

[52] U.S. Cl. ..... 366/22; 106/281 R; 106/283

[58] Field of Search ..... 259/155, 156, 157, 158, 259/159 R; 106/281, 283

[56] References Cited

U.S. PATENT DOCUMENTS

| | | | |
|---|---|---|---|
| 3,614,071 | 10/1971 | Brock | 259/158 X |
| 3,693,945 | 9/1972 | Brock | 259/158 X |
| 3,809,373 | 5/1974 | Brock | 259/155 X |
| 3,866,888 | 2/1975 | Dydzyk | 259/158 |
| 3,999,743 | 12/1976 | Mendenhall | 259/158 |

OTHER PUBLICATIONS

The Asphalt Handbook, published by The Asphalt Institute, Jul. 1962 Edition, Manual Series No. 4 (MS-4), second printing, Mar. 1963; TE 270 A65 1962, C.3 (pp. 128, 129, 131, 132, 177, 178).

*Primary Examiner*—Joan E. Welcome
*Attorney, Agent, or Firm*—Jones, Thomas & Askew

[57] ABSTRACT

Drum mix asphalt plant apparatus connected to a fiber filter dust collector for removing dust and other light particulate matter produced by operation of the drum mixer. Asphalt material is added to the drum mixer in a manner to minimize smoking of the asphalt material due to high temperature within the mixer, and the resulting dust and other fine particulate matter evolved from aggregate material within the drum mixer is withdrawn and collected in a fiber filter dust collector system such as a baghouse. The collected dust is returned to the drum mixer to be coated with asphalt material therein, so that the returned dust becomes admixed with the asphalt aggregate contents of the drum mixer.

6 Claims, 4 Drawing Figures

METHOD OF REDUCING EMISSION OF PARTICULATE MATTER

This is a division of application Ser. No. 685,087, filed May 10, 1976.

This invention relates in general to apparatus for the manufacture of asphalt aggregate material, and in particular to a drum mix asphalt plant having a fiber filter dust collection system.

Drum mixing apparatus is known for use in the preparation of asphalt aggregate paving compositions. It is generally recognized that drum mix asphalt plants provide certain advantages in comparison with other types of asphalt plants, including the economy of continuous-flow operation and relative portability for transportation between job locations. A typical drum mix asphalt plant includes a rotating mixing drum in which aggregate material and asphalt material are separately added and mixed together while being heated to provide the desired asphalt-aggregate mixture. The contents of the mixing drum are heated by a fuel burner located at one end of the drum, and the asphalt-aggregate mixture is removed from the other end of the drum for immediate use or temporary storage in a manner known to those skilled in the art.

The introduction and agitation of aggregate material in the mixing drum of a drum mix asphalt plant, combined with the heating of the aggregate material, produces a substantial volume of dust and other relatively fine airborne particulate mineral matter which emerges from the mixing drum. The amount of such airborne particulate matter may exceed prevailing standards of allowable air pollution, and so drum mix asphalt plants are increasingly required to operate in conjunction with suitable apparatus for reducing the particulate matter to an acceptable maximum level. While fiber filter dust collection systems are frequently used to remove dust and similar fine particulate matter produced by heating and agitating aggregate material alone, the amount of smoke heretofore produced by drum mix asphalt plants has inhibited the application of fiber filter dust collection systems with such plants. Smoke is produced in drum mix asphalt plants by so-called "flashing" of the asphalt material upon exposure to the elevated temperature within the mixing drum, and is caused by evaporation of light end hydrocarbons of the asphalt material to produce blue smoke emissions. These hydrocarbons smoke emissions will rapidly and permanently clog the porous filter media within the typical so-called "baghouse" fiber filter dust collection system, rendering the baghouse inoperative until the filter bags are replaced. Replacement of fuel-clogged filter bags is an expensive expedient and renders the baghouse (and therefore the entire drum mix asphalt plant) inoperative for a period of time.

Since the elevated temperature within the mixing drum must be sufficiently high to dry the aggregate material added to the drum and to provide the desired asphalt-aggregate mix, proposals to reduce smoking have generally called for lengthening the mixing drum so that the asphalt material can be added to the drum at a distance from the burner which minimizes or eliminates smoking, while still providing sufficient drum length for intermixing the asphalt and aggregate materials. Such proposals for extending the length of the mixing drum would add greatly to the cost of new drum mixers, and would be impracticable with existing drum mix asphalt plants.

Because of the problems inherent with using fiber filter dust collection systems with drum mix asphalt plants, such plants have heretofore relied on other filtration expedients such as wet collection systems to remove dust and similar fine particulate matter. Such wet collection systems require a substantial volume of water while operating, and produce a corresponding volume of wet waste product for proper disposal. The water requirements for wet dust collection systems are significant and cannot be met with on-site available water in many locations, so that it may be necessary to transport water to the location of the drum mix asphalt plant solely to operate the wet washer dust collection system.

Other efforts at reducing the dust produced by drum mix plants have called for injecting asphalt material closer to the inlet of aggregate material, i.e., closer to the burner. This method reduces the amount of dust, but produces more smoke because of the higher temperature at the point of asphalt injection.

Accordingly, it is an object of the present invention to provide an improved drum mix asphalt plant.

It is another object of the present invention to provide a drum mix asphalt plant in combination with a fiber filter dust collection system.

It is still another object of the present invention to provide a drum mix asphalt plant in combination with a fiber filter dust collection system, in which removed dust is returned to the mixing drum to be admixed with the asphalt-aggregate composition.

Stated in general terms, the asphalt plant of the present invention comprises a drum mixer which is constructed and operated so as to substantially eliminate the production of hydrocarbon smoke, while using a fiber filter dust collection system to clean the dust-laden air outflow from the drum mixer. The amount of smoke emission from the drum mixer is substantially eliminated or reduced to a level which can be absorbed by the collected dust which becomes caked on the filter medium of the fiber filter dust collection system without damaging the filter medium, and the collected dust is removed from the fiber filter dust collection system and returned to the mixing drum for admixture with the liquid asphalt material being injected to the mixing drum, so that the dust becomes part of the asphalt-aggregate composition being mixed within the drum.

The present invention is better understood and explained with respect to the disclosed embodiment as described hereafter and as shown in the drawing, in which.

Figure 1:
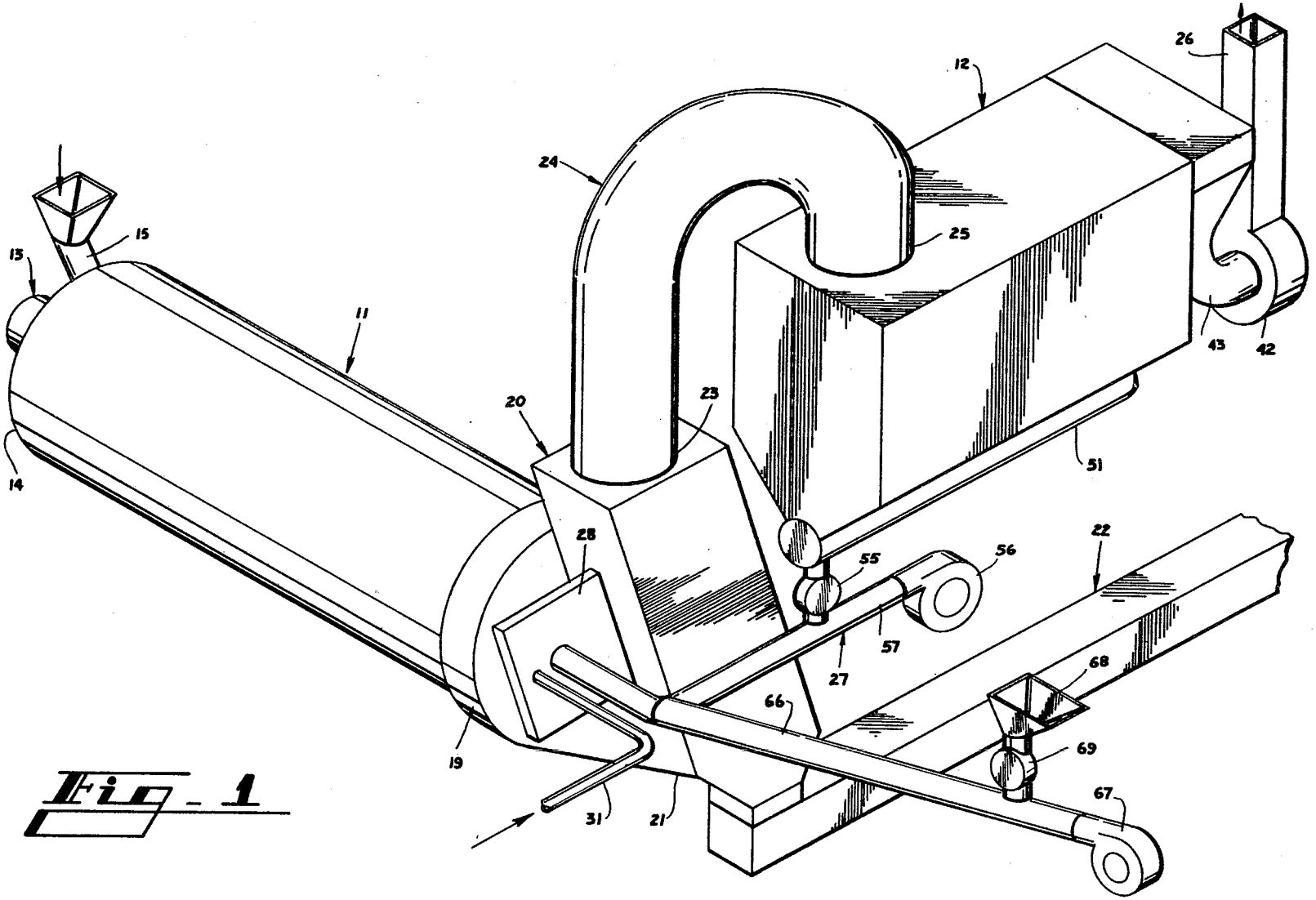
FIG. 1 shows an overall pictorial view of a drum mix asphalt plant according to the disclosed embodiment of the present invention.

Turning first to FIG. 1, there is shown generally at 10 a drum mix system according to the present invention and including a drum mixer 11 and a fiber filter dust collection system 12 hereinafter called a "baghouse". The drum mixer 11 is mounted with its longitudinal axis sloping with respect to horizontal in a manner known to those skilled in the art, and has a fuel-fired burner 13 mounted at the upper end 14 of the drum mixer to heat the interior of the drum mixer. Aggregate material is introduced to the upper end 14 of the drum mixer through the inlet 15 in the conventional manner, and it should be understood that the aggregate inlet 15 is preceded by aggregate material storage, screening, weighing, and conveying apparatus which form no part of the present invention. It should also be understood that the drum mixer 11 is supported and driven for rotation about its longitudinal axis by apparatus which is commonly known in the art and which is omitted from the present description for clarity.

The lower or outlet end 19 of the drum mixer 11 is received for rotation within the outlet housing 20, which provides a plenum for exhausting dust-laden air from the drum mixer and which also directs the outflow of asphalt-aggregate mix from the outlet end of the drum mixer. The asphalt-aggregate mix flows out of the drum mixer 11 and falls by gravity into the mix collector 21 at the bottom of the outlet housing 20, whereupon the mix is received by a suitable conveyor such as the drag chain conveyor 22 which carries the mix directly to a truck for transport to a paving site, or to a suitable storage bin for the hot asphalt-aggregate mix. A knock-out plate 28 is mounted within the outlet housing 20 in spaced apart relation to the outlet end 19 of the drum mixer for impingement of airborne dust particles, which can then drop into the asphalt-aggregate mix.

Attached to the outlet housing 20 at an upper location 23 thereon is the air exhaust conduit 24 which leads to the air inlet 25 of the aforementioned baghouse 12. The dust-laden air which enters the baghouse by the conduit 24 is filtered in the conventional manner, and the filtered air is exhausted from the baghouse through the air exhaust conduit 26. The dust and other light particulate matter which is removed from the air within the baghouse 12 is returned to the drum mixer 11 by way of the dust return conduit 27.

Figure 2:
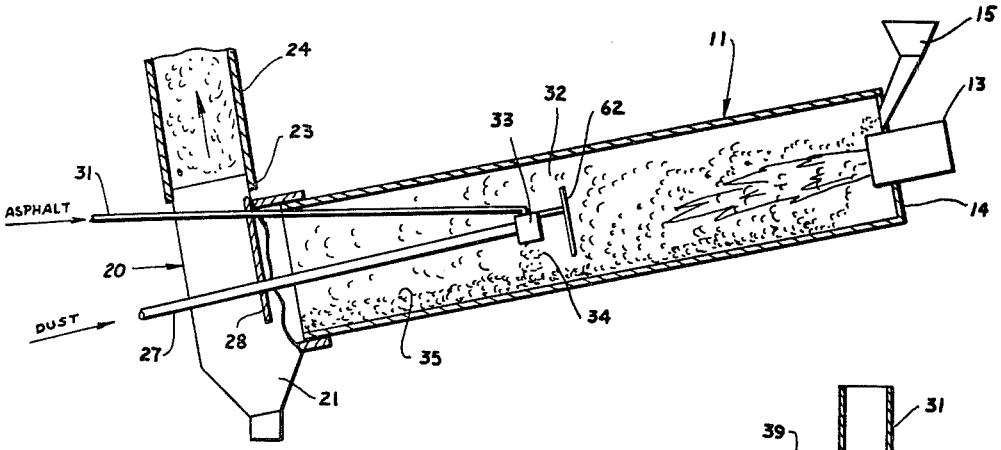
FIG. 2 shows a section view of the drum mixer shown in FIG. 1.

The drum mixer 11 of the disclosed embodiment is shown in greater detail in FIG. 2. Liquid asphalt material is introduced into the drum mixer at the location 32 intermediate the ends of the drum mixer by the asphalt-carrying pipe 31 which receives a metered flow of liquid asphalt material. Also terminating at location 32 within the drum mixer 11 is the aforementioned dust return conduit 27 from the baghouse 12. A stream of dust particles flows into the drum mixer 11 through the conduit 27, and the dust particles exiting the conduit 27 within the drum mixer are mixed with the liquid asphalt flowing from the pipe 31 so that the dust re-entering the mixing drum from the conduit 27 is prevented from again becoming airborne within the drum mixer. The asphalt-coated dust particles thus become admixed with the asphalt-aggregate mixture being prepared within the drum mixer.

Figure 3:
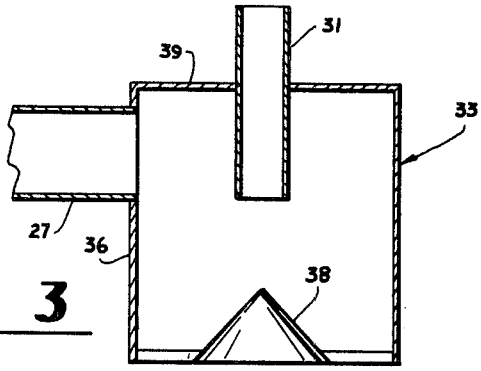
FIG. 3 shows a partially-broken detail view of the cyclone mixer used in the disclosed embodiment.

Intermixing of the liquid asphalt material flowing from the pipe 31 and the dust particles returning to the drum mixer through the conduit 27 is accomplished in the disclosed embodiment with a mixer 33. As best seen in FIG. 3, the mixer 33 includes a cylindrical housing 36 into which the dust return conduit 27 enters at location 37 below the closed upper end 39 of the cylindrical housing. The asphalt delivery pipe 31 extends downwardly through the upper end 39 and terminates within the cylindrical housing 36, in spaced apart relation with a flow diffuser 38 which directs the incoming flow of liquid asphalt radially outwardly toward the interior wall of the cylindrical housing. Incoming dust particles from the conduit 27 enter the cylindrical housing 36 and flow downwardly through the outwardly-radiating flow of liquid asphalt from the diffuser 38 to become coated with liquid asphalt, whereupon the asphalt-laden dust particles exit at 34 from the mixer 33 into the asphalt-aggregate mix 35 within the drum mixer. Other types of apparatus may be used to intermix the asphalt material with the returned dust particles, if appropriate.

Figure 4:
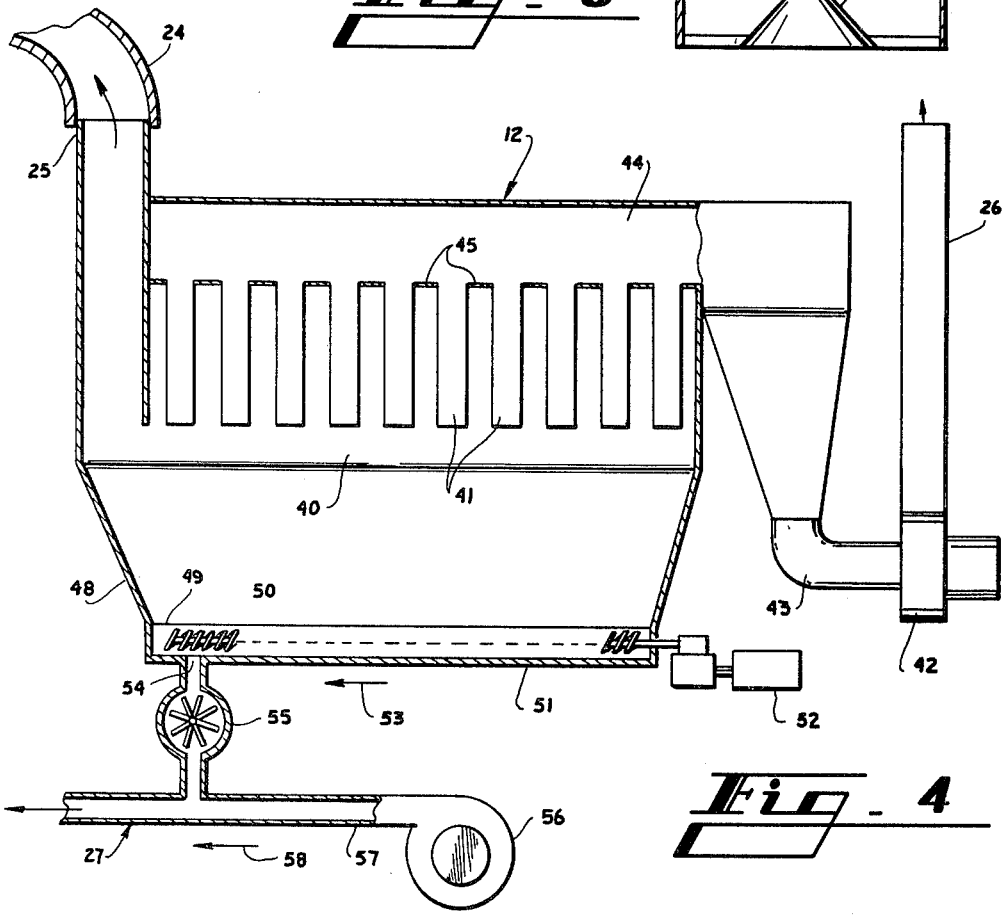
FIG. 4 shows a section view of the filtration system shown in FIG. 1.

Details of a baghouse 12 suitable for use in the present drum mix system 10 are shown in FIG. 4, where it will be understood that the baghouse 12 has an internal filter chamber 40 within which extend a number of fiber filter collectors in the form of filter bags 41. Air flow through the baghouse 12 is provided by an exhaust fan 42 having an inlet duct 43 connected to the plenum 44 which is separated from the filter chamber 40 by the wall 45.

The filter chamber 40 is positioned above a dust collection chamber 48 which takes the shape of a generally V-shaped trough having a narrow end 49 opening into the screw auger 50 which is rotatably contained within the auger chamber 51 extending along the length of the dust collection chamber. The auger 50 is rotated by the drive apparatus 52 to carry dust particles in the direction of arrow 53 toward the auger outlet 54. A rotary airlock 55 is connected between the auger outlet 54 and the dust return conduit 27, and a blower 56 is connected to the end 57 of the dust return conduit upstream from the outlet of the rotary airlock. The blower 56 delivers to the dust return conduit 27 a stream of air moving in the direction indicated by arrow 58, and dust is metered into the airstream by the rotary airlock 55.

Considering the operation of the described embodiment of the present drum mix system, it is assumed that a supply of aggregate material and asphalt material are being admitted to the drum mixer 11 so that the aggregate material is dried by the heat generated within the drum mixer by the burner 13. The aggregate material within the mixing drum is being constantly agitated by rotation of the drum mixer in the conventional manner, with the result that substantial quantities of airborne dust and other fine mineral matter are released by agitation and/or heating of the aggregate material within the drum mixer This fine particulate matter is withdrawn from the drum mixer through the exhaust conduit 24 under influence of the negative pressure produced at the head-end of the baghouse 12 by operation of the exhaust fan 42. The air stream being withdrawn through the open outlet end 19 of the mixing drum 11 may contain particles of dust which are heavier than the aforementioned relatively fine dust particulate matter, but the relatively heavy dust particles impinge on the knock-out plate 28 and are thus removed from the airstream to drop into the asphalt-aggregate mix within the mix collector 21. The relatively fine dust particulate matter flows around the knock-out plate 28 and enters the conduit 24 leading to the baghouse 12.

The fine particulate matter is collected on the outside surfaces of the filter bags 41 within the baghouse 12 in the conventional manner to form a "cake" of dust as air passes through the porous fiber material of the filter bags. This cake of dust is periodically removed from the filter bags 41 by momentarily reversing the flow of air through the bags, in a manner known to those skilled in the art, so that the dust cake is literally blown off the bags to drop downwardly into the dust collection chamber 48. The dust cake is then carried by the auger 51 to the rotary airlock 55, where the dust is metered into the airstream flowing through the dust return conduit 27. The dust is thereby re-admitted to the drum mixer 11 at the location 32, where the re-admitted dust is coated with liquid asphalt material and cannot again become airborne within the drum mixer.

Although it is customary with conventional drum mix asphalt plants to introduce the asphalt material into the drum mixer as closely as possible to the aggregate material inlet 15, so that the aggregate material becomes coated with asphalt to control dust emission at an early point along the length of the drum mixer, it is an important feature of the present drum mix system to introduce the asphalt material at a location within the drum mixer which at least greatly minimizes or eliminates smoking of the asphalt material. Smoking may be substantially reduced or eliminated by moving the asphalt injection location 32 further away from the burner 13, or by providing a shield 62 within the mixing drum between the burner and the point of asphalt injection so as to shield the injected asphalt from radiant heat emitted by the burner. While a greater volume of airborne dust and other light particulate matter is produced within the mixing drum by such relocation of the asphalt injection location, that light particulate matter is removed by the baghouse 12 and returned to the drum mixer without increasing the air pollution of the overall drum mix system 10.

Furthermore, a substantial volume of dust in the air stream received by the baghouse 12 may actually increase the tolerance of the baghouse to filtration of air that contains hydrocarbon smoke particles, since a copious amount of dust permits a more rapid accumulation of dust cake on the filter bags 41 to absorb the hydrocarbon smoke particles before the smoke particles can reach the fiber filter material and become permanently absorbed therein. The dust cake and any hydrocarbon smoke absorbed therein are periodically removed from the filter bags as described above. A drum mix system according to the present invention can thus be designed with a mixing drum that is no longer than heretofore used with prevailing pollution control equipment, since asphalt injection can be controlled as aforementioned to minimize hydrocarbon smoke production while the resulting increase in airborne fine particulate matter is handled by the baghouse.

Occasionally it is desired to add mineral filler in the form of fine dust to the asphalt-aggregate mix. Such mineral filler or similar material can be added, without loss due to airflow within the drum mixer 11, by providing a dust conduit 66 which connects to the dust return conduit 27, or which is otherwise in communication with the mixer 33. A blower 67 maintains an air flow toward the drum mixer 11 through the conduit 66, and the desired additive material within the hopper 68 is metered into the airstream within the conduit 66 by the rotary airlock 69.

It will be apparent that the foregoing relates only to a preferred embodiment of the present invention, and that numerous alternatives and modifications may be provided therein without departing from the spirit and the scope of the invention as defined in the following claims.

We claim:

1. Method of reducing the emission of particulate matter during the preparation of asphalt aggregate mixture in a rotating mixing drum, comprising the steps of:

introducing aggregate material at a first region in the mixing drum whereby airborne particulate matter is present in the mixing drum;

introducing a quantity of liquid asphalt material to said mixing drum for mixture with said aggregate material at a second region in said mixing drum;

passing said airborne particulate matter through a porous filter medium which is external of said mixing drum to separate said airborne particulate matter from air; and combining said separated particulate matter with said liquid asphalt material being introduced to said second region in said mixing drum so as to return said separated particulate matter to said mixing drum.

2. The method of continuously preparing asphalt aggregate mix, comprising the steps of:

passing aggregate material through a heated drum mixing apparatus in a manner which agitates the aggregate material so as to produce airborne particulate mineral matter;

withdrawing air which contains said airborne particulate matter from said drum mixing apparatus and passing said withdrawn air through a porous dry filter medium to separate said particulate matter from the air; and returning said separated particulate matter to said drum mixing apparatus by mixing said separated particulate matter with liquid asphalt that is supplied to the drum mixing apparatus.

3. Method as in claim 2, wherein said liquid asphalt is added to said aggregate material at a location within said drum mixing apparatus which is at a temperature below the flash point of said asphalt so as to minimize the production of smoke caused by heating of the asphalt within the drum mixing apparatus.

4. Method as in claim 2, wherein the air which is removed from said drum mixing apparatus may contain fine airborne particulate matter from said aggregate material and may also contain asphaltic airborne particulate matter, and comprising the additional step of removing said asphaltic airborne particulate matter from said air before passing said air through said porous filter medium.

5. The method as in claim 2, wherein said step of returning said separated particulate matter to said drum mixing apparatus comprises the steps of:

mixing together said separated particulate matter and said liquid asphalt within said drum mixing apparatus; and then mixing said asphalt-mixed particulate matter with said aggregate material within said drum mixing apparatus.

6. The method as in claim 2, wherein said separated particulate matter and said liquid asphalt are mixed together within said drum mixing apparatus.

* * * * *